US006649034B1

(12) United States Patent
Tran et al.

(10) Patent No.: US 6,649,034 B1
(45) Date of Patent: Nov. 18, 2003

(54) ELECTRO-CHEMICAL METAL ALLOYING FOR SEMICONDUCTOR MANUFACTURING

(75) Inventors: Minh Quoc Tran, Milpitas, CA (US); Amit P. Marathe, Milpitas, CA (US); Pin-Chin Connie Wang, Menlo Park, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 239 days.

(21) Appl. No.: 09/894,191

(22) Filed: Jun. 27, 2001

(51) Int. Cl.[7] ..... C25B 15/00; C25B 9/00; C25D 17/00

(52) U.S. Cl. ..... 204/237; 204/224 R; 204/269

(58) Field of Search ..... 204/267, 269, 204/237; 205/238–239, 256, 157, 240–242

(56) References Cited

U.S. PATENT DOCUMENTS 1,920,964 A * 8/1933 Burns ..... 205/256
4,554,056 A * 11/1985 Whitford ..... 205/60
5,441,620 A * 8/1995 Nishimura et al. ..... 204/231
6,413,390 B1 * 7/2002 Tran ..... 204/237

OTHER PUBLICATIONS

U.S. patent application Ser. No. 09/678,503, Tran., filed Oct. 2, 2000.

* cited by examiner

*Primary Examiner*—Donald R. Valentine
(74) *Attorney, Agent, or Firm*—Mikio Ishimaru

(57) ABSTRACT

The present invention provides an alloy electroplating system for semiconductor wafers including a plating chamber connected by a circulating system to a plating solution reservoir. The semiconductor wafer is used as the cathode with an inert primary anode in the plating chamber. A plurality of consumable remote secondary anodes at different voltages in the plating solution reservoir provides the metal ions for alloy plating.

20 Claims, 2 Drawing Sheets

ELECTRO-CHEMICAL METAL ALLOYING FOR SEMICONDUCTOR MANUFACTURING

TECHNICAL FIELD

The present invention relates generally to semiconductor manufacturing technology and more specifically to electroplating systems using consumable anodes.

BACKGROUND ART

In the past in the manufacture of semiconductors, there have been numerous processes which required plating at various stages to deposit various materials on semiconductor wafers. All of these systems generally required human operator monitoring or the addition of plating materials at timed intervals. Since the addition of plating material was deemed to be one which required a certain degree of expertise and experience, it was not thought to be possible to automate this type of operation without complex, and expensive, computer equipment.

As the industry has sought to make smaller and smaller semiconductor devices with finer and finer device connections, it has been found that conventional metallization techniques for making the device connections are inadequate for future generations of products. This has resulted in the shift from materials such as aluminum (Al) to copper (Cu).

Copper is not suited for deposition using the metallization techniques used for aluminum and is better adapted for deposition by electro- or electro-less plating processes out of a solution. With the adoption of the copper interconnect, the device connection technology, there has been a great deal of effort placed into automating copper plating technology for semiconductors. This has meant the introduction of expensive equipment. This in turn has meant that much effort has been expended in trying to reduce costs.

One of the processes for depositing copper uses a consumable primary anode in the plating chamber. As the consumable primary anode is consumed, it changes the geometry and the electromotive force in the plating chamber leading to non-uniform deposition of the copper. Non-uniform deposition of the copper leads to difficulties in following planarization steps and in defective integrated circuits around the perimeter of the semiconductor wafer.

Further, although there has been a long sought need for a method of alloying the conductor metals deposited by electro-plating or electro-chemical deposition, no method has been developed for accomplishing this objective.

A solution for solving these problems simply and inexpensively has been long sought by and eluded those skilled in the art.

DISCLOSURE OF THE INVENTION

The present invention provides an metal alloy electroplating system for semiconductor wafers including a plating chamber having a plurality of consumable remote secondary anodes connected by a circulating system to a plating solution reservoir. The semiconductor wafer is used as the cathode with an inert primary anode in the plating chamber and a remote consumable secondary anode in the plating solution reservoir for providing the metal ions for plating. The consumption of the consumable remote secondary anodes does not change the geometry or the electromotive force in the plating chamber and maintains a uniform thickness metal alloy conductor core deposition which is easily planarized.

The present invention further provides a copper alloy electroplating system for semiconductor wafers including a plating chamber having a plurality of consumable copper and alloy metal remote secondary anodes connected by a circulating system to a copper plating solution reservoir. The semiconductor wafer is used as the cathode with an inert platinum anode in the plating chamber and remote consumable copper and alloy metal secondary anode in the plating solution reservoir for providing the metal ions for plating. The consumption of the consumable remote secondary anodes does not change the geometry or the electromotive force in the plating chamber and maintains a uniform thickness copper alloy deposition which is easily planarized.

The above and additional advantages of the present invention will become apparent to those skilled in the art from a reading of the following detailed description when taken in conjunction with the accompanying drawings.

BEST MODE FOR CARRYING OUT THE INVENTION

Figure 1:
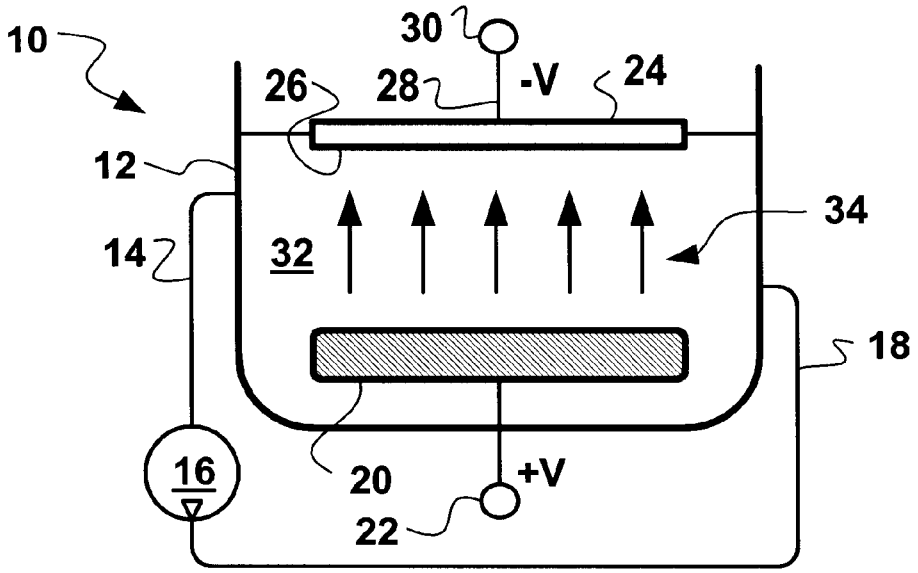
FIG. 1 (PRIOR ART)
FIG. 1 (PRIOR ART) shows a plating chamber containing a consumable anode.

Referring now to FIG. 1 (PRIOR ART), therein is shown an electroplating system 10 having a plating chamber 12. The plating chamber 12 has an outlet 14 connected to a circulating pump 16, which is further connected to an inlet 18 to the plating chamber 12.

Within the plating chamber 12 is a consumable primary anode 20 connected to a positive voltage source 22.

Above the consumable primary anode 20 is a semiconductor wafer 24 having a conductive seed layer 26 thereon. The seed layer 26 is connected by a connector 28 to a voltage less than the voltage of the positive voltage source, or a negative voltage source 30, and acts as the cathode for the plating process. The configuration described can be extended to allow for pulse plating, or waveform manipulation, by attaching an appropriate power supply where the potential applied on the anode and cathode is simultaneously reversible.

The semiconductor wafer 24 is positioned so as to place the seed layer 26 in contact with a plating solution 32.

For the electroplating of copper the consumable primary anode 20 is made of copper and the plating solution 32 contains free copper ions. When the voltages are applied, copper ions are migrated from the consumable primary anode 20 to the seed layer 26 along the electromotive field indicated by straight arrows 34 through the plating solution 32. The plating solution 32 is recirculated by the circulating pump 16 to maintain as constant a copper ion concentration as possible while the cathodic reaction at the seed layer 26 causes the deposition of metallic copper on to the seed layer 26.

Figure 2:
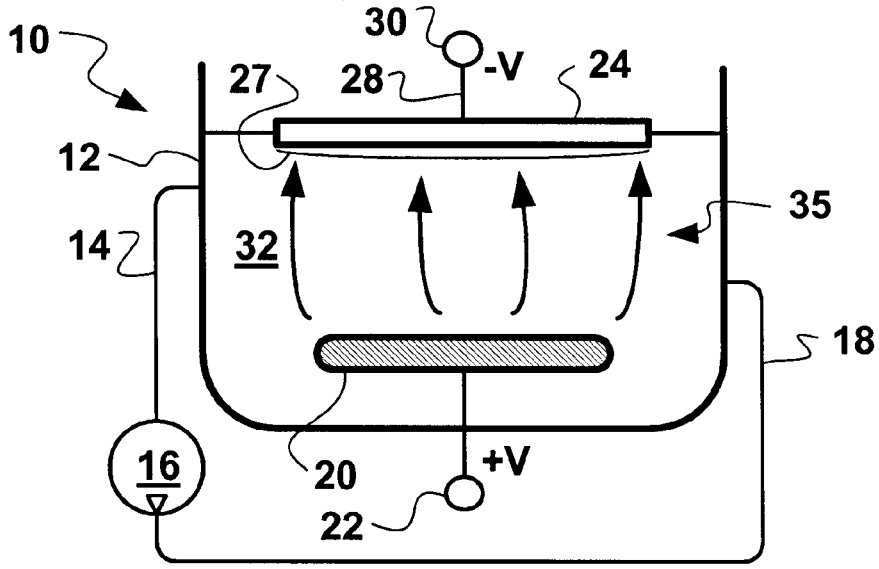
FIG. 2 (PRIOR ART)
FIG. 2 (PRIOR ART) shows a plating chamber with a portion of the consumable anode consumed.

Referring now to FIG. 2 (PRIOR ART), therein is shown the electroplating system 10 during the electroplating process. The consumable primary anode 20 is shown partially consumed and significantly reduced in size, which changes the geometry and the electromotive force in the plating chamber 12. The shape of the electromotive field, as indicated by curved arrows 35, influences the deposition of the metal ions on the seed layer 26 of the semiconductor wafer 24.

Due to the change in the geometry and the electromotive field in the plating chamber 12, the deposition of a metal 27 on the semiconductor wafer 24 will be uneven and generally convex. The metal 27 will be thickest where the distance between the consumable primary anode 20 and the semiconductor wafer 24 is the shortest and will be thinner where the consumable primary anode 20 and the semiconductor wafer 24 are further apart.

The variation in thickness of the metal 27 makes it very difficult to properly planarize the semiconductor wafer 24 by subsequent chemical-mechanical planarization processes and results in defective integrated circuits around the perimeter of the semiconductor wafer 24. Further, only one metal can be electroplated at one time so the metal cannot be an alloy.

Figure 3:
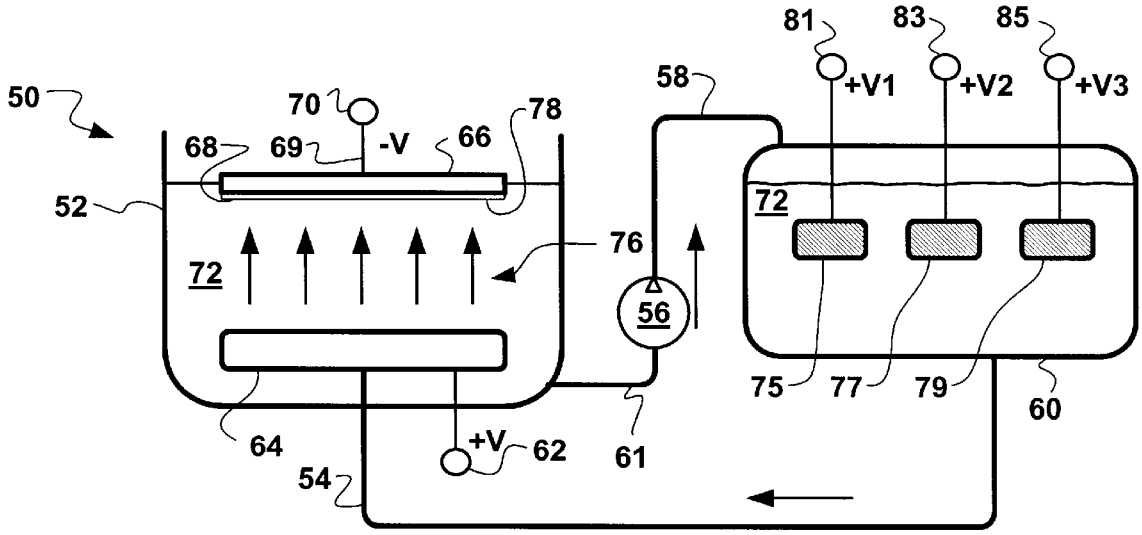
FIG. 3 shows a plating chamber having remote anodes according to the present invention.

Referring now to FIG. 3, therein is shown an electroplating system 50 according to the present invention. The electroplating system 50 includes a plating chamber 52 having an outlet 54 connected to a circulating pump 56, which is further connected by an inlet 58 to a plating solution reservoir 60. The plating solution reservoir 60 is connected by a second inlet 61 back to the plating chamber 52. As evident, the circulating pump 56 could also be in the outlet 54.

Within the plating chamber 52 is an inert primary anode 64 connected to a positive voltage source 62. The inert primary anode 64 is of a material, which will not take part in the plating process and which is not consumed, such as platinum (Pt).

Above the inert primary anode 64 is a semiconductor wafer 66 having a conductive seed layer 68 thereon. The seed layer 68 is connected by a connector 69 to a negative voltage source 70 and acts as the cathode for the plating process. The semiconductor wafer 66 is positioned so as to place the seed layer 68 in contact with a plating solution 72.

In the plating solution reservoir 60 are a plurality of consumable remote secondary anodes 75, 77, and 79 by way of example for a three metal alloy electroplating process. Two metals can be alloyed and additional alloying metals can be added just by adding an additional consumable remote secondary anode.

The plurality of consumable remote secondary anodes 75, 77, and 79 are respectively connected to a plurality of positive voltage sources 81, 83, and 85, respectively. The alloying composition is controlled by the immersion of an anode in the plating solution 72, the composition of the plating solution 72, and the strength of the voltage potentials at the positive voltage sources 81, 83, and 85.

The plurality of consumable remote secondary anodes 75, 77, and 79 is placed remotely so that, as it is consumed, the geometry and the electromotive field in the plating chamber 52 do not change so the electromotive field for metal ions plated on the seed layer 68 is always the same and directly between the inert primary anode 64 and the semiconductor wafer 66 as indicated by the straight arrows 76.

With the electromotive field being direct, plated alloy metal 78 on the seed layer 68 will be of a uniform thickness which will be easily planarized by subsequent chemical-mechanical planarization processes.

In operation, the plurality of consumable remote secondary anodes 75, 77, and 79 introduce metal ions to the plating solution 72 in the plating solution reservoir 60. The plating solution 72 is then recirculated to the plating chamber 52 either by gravity feed (as shown) or pumping (not shown). In the plating chamber 52, the inert primary anode 70 and the seed layer 68 provide the electromotive force to deposit the metal ions onto the seed layer 68.

The outlet 54 is connected to the bottom of the plating solution reservoir 60 and is positioned, as indicated by an arrow, for upward flow of the plating solution 72 Into the plating chamber 52 and uniform flow around the perimeter of the inert primary anode 64 toward the cathode connector 69 and the semiconductor wafer 66. The inlet 58 is positioned adjacent to the periphery of the inert primary anode 64 to minimize or avoid interfering with the uniform flow of the plating solution 72 around the inert primary anode 64.

As the metal ions are deposited and the plating solution 72 becomes diluted, it is recirculated by the pump 56 (as shown) or gravity fed (not shown) back to the plating solution reservoir 60 where the plurality of consumable remote secondary anodes 75, 77, and 79 will replenish the metal ions as required.

In the deposition of alloy copper on the semiconductor wafer 66, the seed layer 68 is of copper deposited by a process such as sputtering or chemical vapor deposition, and the inert primary anode 64 is of platinum (Pt), the consumable remote secondary anode 75 is of metallic copper, the consumable remote secondary anode 77 is of tin, and the consumable remote secondary anode 79 is of chromium.

By having the inert primary anode 70 in the plating chamber 52, the geometry and the electromotive field in the plating chamber 52 are not changed during plating because the inert primary anode 70 does not dissolve and because the plurality of consumable remote secondary anodes 75, 77, and 79 is in a separate area independent of the geometry and the electromotive field in the plating chamber 52.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations which fall within the spirit and scope of the appended claims. All matters hither-to-fore set forth herein or shown in the accompanying drawings are to be interpreted in an illustrative and non-limiting sense.

The invention claimed is:

1. A plating system for an object comprising:

a plating chamber;

a plating solution reservoir connected to the plating chamber;

an inert primary anode in the plating chamber and connectible to a voltage source;

a cathode connector in the plating chamber and connectible to connect the object to the voltage source;

a circulating system for circulating plating solution between the plating chamber and the plating solution reservoir, the circulating system having an outlet into the plating chamber positioned for uniform flow of the plating solution around the inert primary anode toward the cathode connector;

a plurality of consumable remote secondary anodes in the plating solution reservoir; and a plurality of voltage sources for connection to the plurality of consumable remote secondary anodes.

2. The plating system as claimed in claim 1 wherein the plurality of consumable remote secondary anodes is of a plurality of different metals.

3. The plating system as claimed in claim 1 wherein the plurality of voltage sources is of a plurality of different voltages.

4. The plating system as claimed in claim 1 wherein the circulating system includes a pumping system for circulating plating solution between plating solution reservoir and the plating chamber.

5. The plating system as claimed in claim 1 including plating solution in the plating chamber covering the inert primary anode and the plurality of consumable remote secondary anodes.

6. The plating system as claimed in claim 1 wherein the object has a seed layer and including plating solution in the plating chamber to contact the seed layer.

7. A plating system for a semiconductor wafer comprising:

a plating chamber;

a plating solution reservoir connected to the plating chamber;

an inert primary anode in the plating chamber and connectible to a voltage source;

a semiconductor wafer connector in the plating chamber and connectible to connect the semiconductor wafer to the voltage source;

a circulating system for circulating plating solution between the plating chamber and the plating solution reservoir, the circulating system having an outlet into the plating chamber positioned for uniform flow of the plating solution around the inert primary anode toward the cathode connector and an inlet from the plating chamber to the plating solution reservoir positioned to avoid interfering with the uniform flow of the plating solution around the inert primary anode;

a plurality of consumable remote secondary anodes in the plating solution reservoir; and a plurality of voltage sources for connection to the plurality of consumable remote secondary anodes.

8. The plating system as claimed in claim 7 wherein the plurality of consumable remote secondary anodes is of a plurality of different metals.

9. The plating system as claimed in claim 7 wherein the plurality of voltage sources is of a plurality of different positive voltages.

10. The plating system as claimed in claim 7 wherein the circulating system includes a pumping system for circulating plating solution between plating solution reservoir and the plating chamber.

11. The plating system as claimed in claim 7 including plating solution in the plating chamber covering the inert primary anode and the plurality of consumable remote secondary anodes.

12. The plating system as claimed in claim 7 wherein the semiconductor wafer has a seed layer and including plating solution in the plating chamber to contact the seed layer.

13. A copper alloy plating system for a semiconductor wafer comprising:

a copper plating chamber;

a copper ion plating solution reservoir connected to the plating chamber;

an inert platinum anode in the copper plating chamber having a silicon wafer size area and connectible to a positive voltage source;

a semiconductor wafer connector in the copper plating chamber above the inert platinum anode and connectible to connect the semiconductor wafer to a negative voltage source;

a circulating system far circulating copper ion plating solution between the copper plating chamber and the copper ion plating solution reservoir, the circulating system having an outlet into the copper plating chamber positioned for uniform upward flow of the copper ion plating solution around the perimeter of the inert platinum anode toward the cathode connector and an inlet from the copper plating chamber to the copper ion plating solution reservoir positioned adjacent the periphery of the inert platinum anode to avoid interfering with the uniform flow of the copper ion plating solution around the inert platinum anode, the circulating system having an outlet from the bottom of the copper ion plating solution reservoir; and a plurality of remote consumable anodes in the copper plating solution reservoir, one of the plurality of remote consumable anodes being a remote consumable copper anode; and a plurality of positive voltage sources for connection to the plurality of consumable secondary anodes.

14. The copper plating system as claimed in claim 13 wherein plurality of consumable remote secondary anodes are of a plurality of different metals.

15. The plating system as claimed in claim 13 wherein the plurality of voltage sources is of a plurality of different voltages.

16. The plating system as claimed in claim 13 wherein the circulating system includes a pumping system for pumping copper ion plating solution between the copper plating chamber and the copper ion plating solution reservoir.

17. The copper plating system as claimed in claim 13 including copper ion plating solution in the copper plating chamber covering the inert platinum anode and the remote consumable copper anode.

18. The copper plating system as claimed in claim 13 wherein the semiconductor wafer has a copper seed layer and including copper ion plating solution in the copper plating chamber to contact the copper seed layer.

19. A plating system for an object having a conductive surface comprising:

a plating chamber;

a plating solution reservoir connected to the plating chamber;

a plating solution in the plating chamber and the plating solution reservoir;

an inert primary anode in the plating chamber and connectible to a voltage source;

a connector for the object in the plating chamber and connectible to connect the conductive surface of the object to the voltage source;

a circulating system for circulating plating solution between the plating chamber and the plating solution reservoir, the circulating system having an outlet into the inert primary anode toward the cathode connector and an inlet from the plating chamber to the plating solution reservoir positioned to avoid interfering with the uniform flow of the plating solution around the inert primary anode;

a plurality of consumable remote secondary anodes in the plating solution reservoir, each of the plurality of consumable remote secondary anodes of a different metal; and a plurality of voltage sources for connection to the plurality of consumable remote secondary anodes, each of the plurality of voltage sources at a different voltage.

20. A plating system for a semiconductor wafer comprising:

a plating chamber;

a plating solution reservoir connected to the plating chamber;

a plating solution in the plating chamber and the plating solution reservoir an inert primary anode in the plating chamber and connectible to a positive voltage source;

a semiconductor wafer connector in the plating chamber and connectible to connect the semiconductor wafer to a negative voltage source;

a circulating system for circulating plating solution between the plating chamber and the plating solution reservoir, the circulating system having an outlet into the plating chamber positioned for uniform flow of the plating solution around the inert primary anode toward the cathode connector and an inlet from the plating chamber to the plating solution reservoir positioned to avoid interfering with the uniform flow of the plating solution around the inert primary anode;

a plurality of consumable remote secondary anodes in the plating solution reservoir, each of the plurality of consumable remote secondary anodes of a different metal; and a plurality of sources of positive voltage for connection to the plurality of consumable remote secondary anodes, each of the plurality of positive voltage sources at a different voltage.

* * * * *

UNITED STATES PATENT AND TRADEMARK OFFICE

CERTIFICATE OF CORRECTION

PATENT NO. : 6,649,034 B1
DATED : November 18, 2003
INVENTOR(S) : Tran et al.

It is certified that error appears in the above-identified patent and that said Letters Patent is hereby corrected as shown below:

Column 4,
Line 3, delete "Into" and insert therefore -- into --

Column 5,
Line 64, delete "far" and insert therefore -- for --

Column 6,
Line 51, before "inert", insert therefore -- plating chamber positioned for uniform flow of the plating solution around the --

Signed and Sealed this

Thirteenth Day of January, 2004

JON W. DUDAS
*Acting Director of the United States Patent and Trademark Office*